United States Patent [19]

Cretella et al.

[11] 4,065,879

[45] Jan. 3, 1978

[54] TURBINE VANE AIR-FOIL SURFACE GRINDER

[76] Inventors: Salvatore J. Cretella, 180 Fitch St., North Haven, Conn. 06473; Matthew Bernardo, 62 Lee St., West Haven, Conn. 06516; Ralph T. DeMusis, 547 Foxon Road, North Branford, Conn. 06471

[21] Appl. No.: 687,396

[22] Filed: May 17, 1976

[51] Int. Cl.[2] ..... B24B 21/02; B24B 19/14

[52] U.S. Cl. ..... 51/145 R; 51/237 R

[58] Field of Search ..... 51/101 R, 144, 145 R, 51/217 T, 237 R; 279/35; 269/270, 321 W

[56] References Cited

U.S. PATENT DOCUMENTS

| | | | |
|---|---|---|---|
| 2,527,285 | 10/1950 | Whitehead | 51/101 R |
| 2,577,128 | 12/1951 | Johnson | 51/101 R |
| 2,702,495 | 2/1955 | Creek | 51/101 R X |
| 2,721,423 | 10/1955 | Haussler | 51/101 R |
| 3,834,085 | 9/1974 | Moeller | 51/101 R X |
| 3,969,848 | 7/1976 | DeMusis | 51/141 |
| 3,973,360 | 8/1976 | Crevoisier | 51/101 R |

FOREIGN PATENT DOCUMENTS

| | | | |
|---|---|---|---|
| 1,330,262 | 9/1973 | United Kingdom | 51/144 |

*Primary Examiner*—James L. Jones, Jr.
*Assistant Examiner*—Nicholas P. Godici
*Attorney, Agent, or Firm*—H. Gibner Lehmann; K. Gibner Lehmann

[57] ABSTRACT

A machine for resurfacing the air-foil surfaces of turbine vanes and the like, comprising a base and a carriage movable over the base toward a work-performing station thereof. The base carries a power-driven abrasive belt which extends past the work-performing station, for engagement with the air-foil surface of the vane to be resurfaced. The latter is rotatably mounted on the carriage so as to be capable of turning during its engagement with the belt. The movement of the carriage over the base is governed by a cam and cam follower on the two parts, respectively, and a linkage is provided for effecting simultaneous synchronous turning of the cam and the vane. The arrangement is such that the position of the carriage with respect to the base is determined by the rotary position of the cam, and thus the contour of the latter affects the amount of resurfacing of the vane which occurs.

17 Claims, 15 Drawing Figures

TURBINE VANE AIR-FOIL SURFACE GRINDER

CROSS REFERENCES TO RELATED APPLICATIONS

1. Co-pending application in the name of Ralph T. DeMusis, entitled METHOD AND MEANS FOR REPAIRING TURBINE VANES, U.S. Ser. No. 538,839, filed Dec. 2, 1974.

2. Co-pending application in the name of Ralph T. DeMusis, entitled TURBINE BLADE AIR SEAL, SIDE GRINDER, U.S. Ser. No. 574,563, filed May 5, 1975, now: U.S. Pat. No. 3,984,212 dated Oct. 5, 1976;

3. Co-pending application in the name of Ralph T. DeMusis, entitled TURBINE BLADE AIR SEAL, EDGE GRINDER, U.S. Ser. No. 574,564, filed May 5, 1975, now: U.S. Pat. No. 3,969,848 dated July 20, 1976.

4. Co-pending application in the names of Ralph T. DeMusis, Salvatore J. Cretella and Matthew Bernardo, entitled REFURBISHED TURBINE VANES AND METHOD OF REFURBISHMENT THEREOF, U.S. Ser. No. 613,479, filed Oct. 15, 1975 now U.S. Pat. No. 4,402,877.

5. Co-pending application in the name of Salvatore J. Cretella, entitled TURBINE BLADE EDGE GRINDER, U.S. Ser. No. 625,071, filed Oct. 23, 1975 now U.S. Pat. No. 4,016,683 issued Apr. 5, 1977.

6. Co-pending application in the name of Ralph T. DeMusis, entitled METHOD OF REFURBISHING TURBINE BLADE AIR SEAL FLANGES, U.S. Ser. No. 648,388, filed Jan. 12, 1976 now U.S. Pat. No. 4,402,888.

BACKGROUND

This invention relates generally to resurfacing machines and more particularly to devices of this type which are adapted to impart a desired, predetermined contour to portions of a workpiece, such as a turbine vane or the like.

After extended periods of use, the vanes employed in turbine engines tend to become worn along their air foil surfaces due to heat and abrasion from particles of sand or debris which are encountered during operation. In addition, small surface cracks tend to develop. When these occur, it is necessary to replace or repair the vane since such cracks will in time deepen and ultimately cause failures. Because the fabrication of these units is expensive, involving close tolerances and special metal alloys, it has been found desirable to refinish worn or damaged vanes whenever possible, instead of merely discarding them and substituting new units. Generally the vane surface is built up at the worn area, as by a plasma spray process described in one of the co-pending applications above identified. Following such buildup, small amounts of metal are removed by grinding, resulting in a restoration in the original vane dimensions, to thereby enable them to again be placed in use. One of the problems encountered in removing controlled amounts of material is that it has been difficult to judge how much metal has to be removed after the process has begun. In addition, achieving good uniformity from one unit to another is not had when the grinding or resurfacing is done by hand. In the latter case, it is likely that too little material will be removed on certain portions of the vane, with too much being ground off at other areas. Accordingly, it has been found that resurfacing such air foil surfaces is exceedingly difficult to accomplish by hand, in view of the close tolerences involved.

Specialized machines have been developed for resurfacing limited areas of the vanes, such as the leading edge, or the convex air-foil surface thereof. However, such devices were operable only over a portion of the vane surface. Repair or refinishing of other portions frequently required separate operations in multiple machines.

SUMMARY

The above drawbacks and disadvantages of prior resurfacing devices are obviated by the present invention, which has for an object the provision of a novel and improved machine for precisely resurfacing the entire peripheral air-foil surface of a turbine vane in a single operation, the machine being simple in construction, reliable in operation, and capable of attaining highly accurate and uniform results from one unit to the next. A related object is the provision of a machine as above, which involves no complex set-up procedures, and which requires a minimum of judgement on the part of the operator, thereby tending to reduce the overall operator-related error.

The above objects are accomplished by the provision of a novel turbine vane resurfacing machine comprising a base part, a carriage part movable over the base part toward and away from a work-performing station thereon, and a power-driven abrasive belt carried by the base part and presenting a cutter surface at the work performing station. Means are provided on the carriage for rotatably mounting the vane to be resurfaced and for enabling the entire air-foil periphery thereof to be continuously presented for engagement with the cutting surface of the belt as the carriage part moves relative to the work-performing station. A cam is carried by one of the parts and a cam follower by the other of said parts and engaging the cam. Drive means are provided, connecting the cam and the vane mounting means to thereby effect simultaneous synchronous rotation of the cam and the vane, whereby the resurfacing of the latter is governed by the particular contour of the cam. Unique spring means maintains the cam engaged with the cam follower and provides a yielding action which can occur if excessive forces are encountered when the abrading operations are being performed on the vane. Such yielding action constitutes a safety factor and prevents excessive belt wear while insuring uniform removal of built-up metal from the air-foil surface of the vane. Precision reciprocating movement of the carriage results due to the precise contour of the cam, causing removal of only carefully controlled quantities of the complete air-foil surface to the ends that the geometry and surface characteristics of a refinished vane closely resemble those of a new unit.

The machine is both rugged and easy to use. Excellent surface uniformity between different resurfaced vanes is realizeable. Other features and advantages will hereinafter appear.

In the drawings, illustrating a preferred embodiment of the invention:

Figure 1:
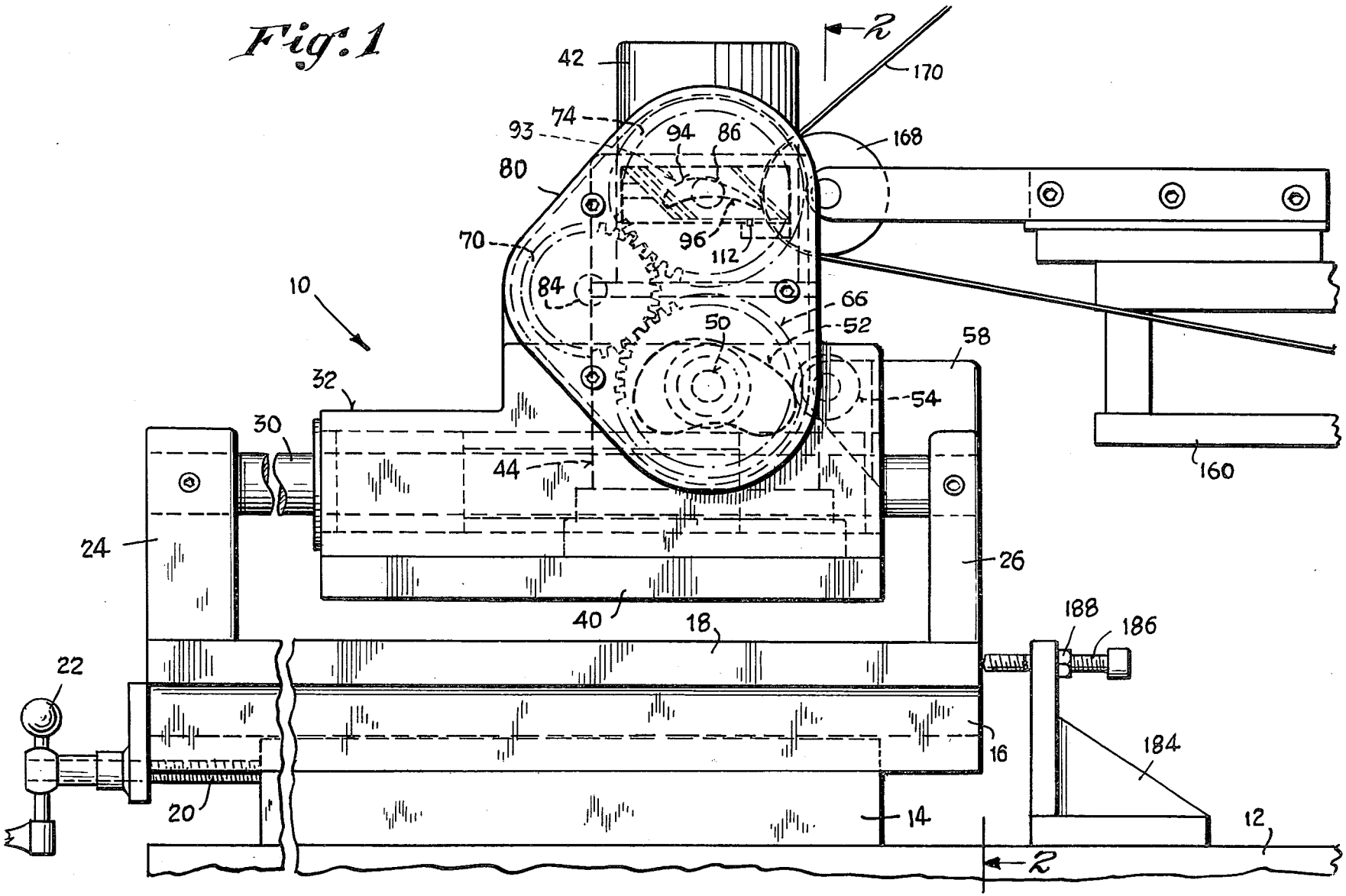
FIG. 1 is a fragmentary side elevational view of the improved turbine vane resurfacing machine of the present invention, showing the movable carriage and the abrasive belt carried by the machine base.
Figure 2:
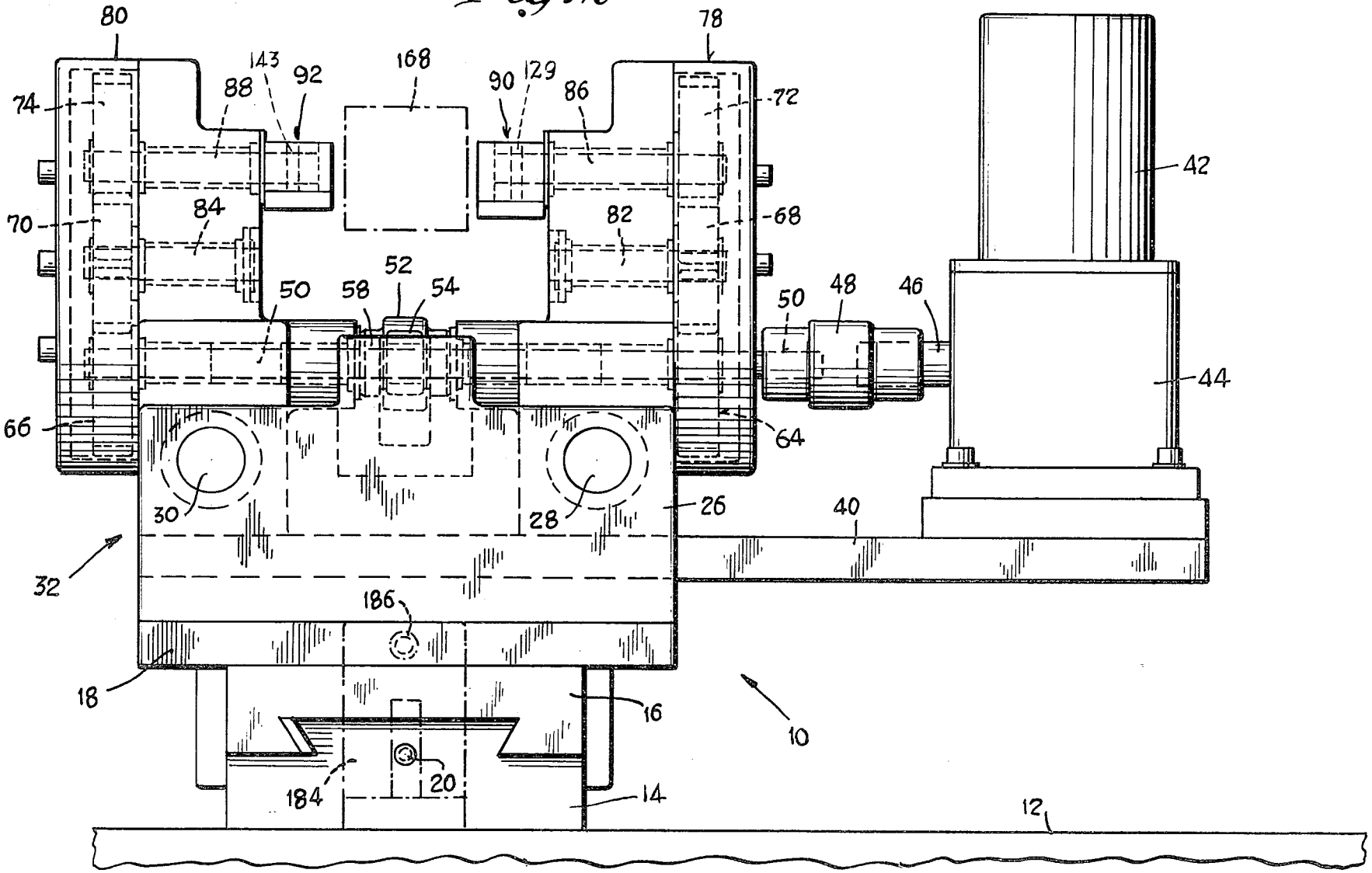
FIG. 2 is a view taken on the line 2—2 of FIG. 1.
Figure 3:
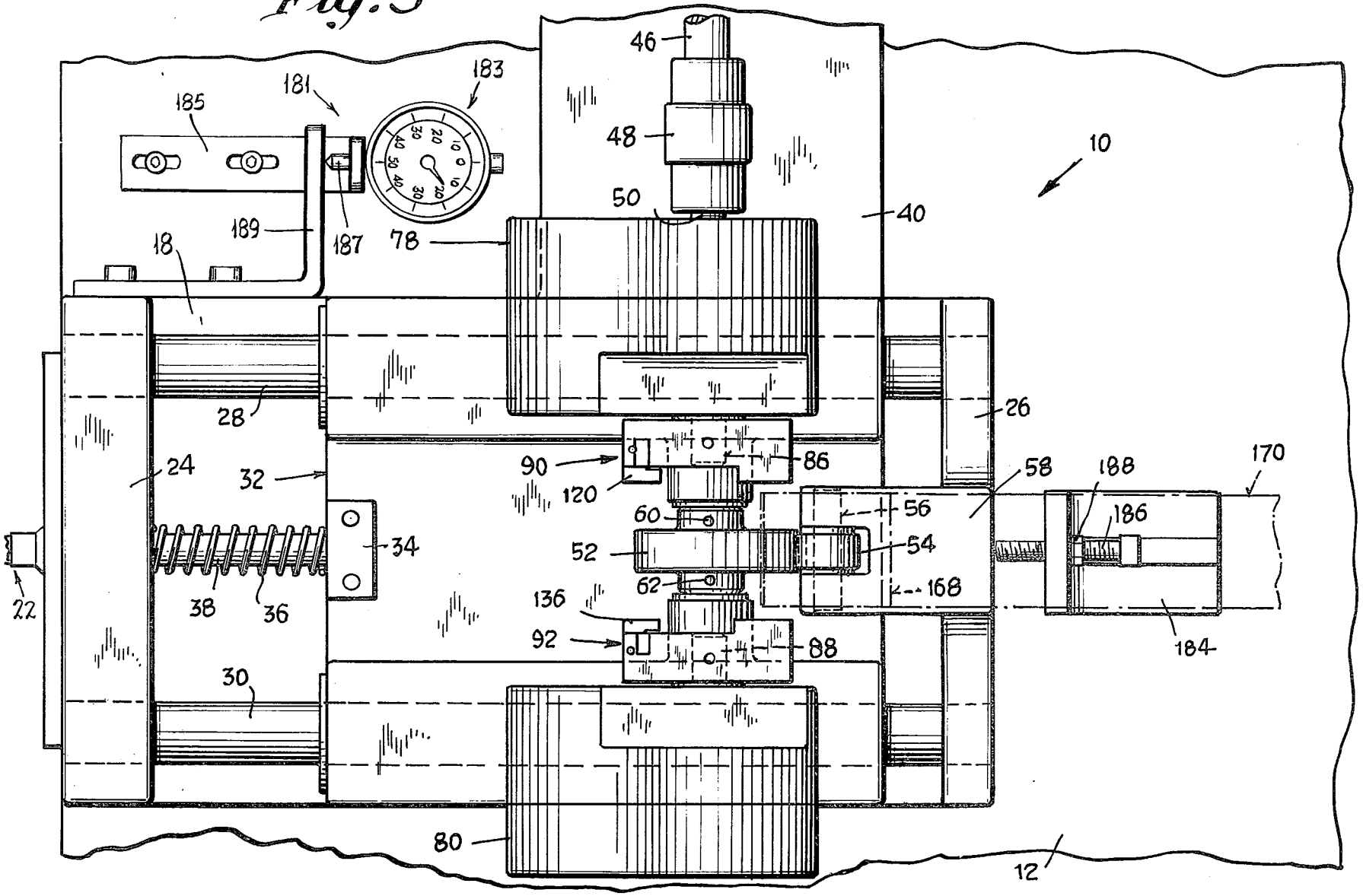
FIG. 3 is a top plan view of the improved turbine vane resurfacing machine of the present invention.

Referring to FIGS. 1-3, and in accordance with the present invention there is illustrated a novel and improved machine for resurfacing the complete air-foil surface of a turbine vane or the like, the machine being generally designated by the numeral 10 and comprising a frame 12 having a dove-tail guide 14 carrying a corresponding dove-tail slide 16, and a plate 18 which is secured thereto. The slide 16 and plate 18 as well as the frame 12 and guide 14, can be considered to constitute a base part of the machine. The guide 14 has a threaded hole which receives an adjustment screw 20, turnable by means of a crank handle or micrometer feed handle 22 for effecting positioning of the plate 18 with respect to the frame 12.

The plate 18 comprises two upstanding end blocks 24, 26 which carry a pair of co-extensive cylindrical guide members 28, 30, as shown in FIG. 3. Slidably mounted on the guide members 28, 30 is a carriage 32, which includes an abutment member 34.

As provided by this invention a unique control of the carriage 32 is had, by which the latter can yield somewhat when it is being advanced during the cutting stroke hereinafter explained. Such yielding can occur if the manual advance of the carriage is too rapid or if there are excessively high spots in the built-up metal that was applied to the worn vane. The yielding does not occur where the built-up metal is relatively uniform in thickness and/or where the micrometer advance of the carriage (hereinafter described) is effected by small increments of the micrometer feed handle 22. In its simplest form, the above control device provided for the carriage 32 can be a simple coil spring. As seen in FIG. 3, such spring can be of the compression type and extends between the upstanding member 24 and the carriage abutment member 34. A guide rod 38 is provided, extending into a hole in the carriage, in order to maintain the spring in a fixed axial position. By such an arrangement, the opposite ends of the spring are in continuous engagement with the end block 24 and the abutment block 34, and thus the spring biases the carriage 32 toward the right in FIGS. 1 and 3 with respect to the plate 18.

Referring now to FIG. 2, it can be seen that the carriage 32 includes an extension or platform 40 on which there is mounted an electric motor 42 and gear reduction box 44. The latter has an output shaft 46 which in turn carries a flexible coupling 48 adapted to impart drive power to a main drive shaft 50. As particularly shown in FIGS. 1-3, this drive shaft 50 carries a cam 52 having a profile resembling that of an air-foil surface. The cam is engaged by a cam follower 54 in the form of a circular, freely turnable wheel carried on a shaft 56 which is mounted on an upstanding block 58 disposed at one end of the plate 18. The cam 52 is secured to the drive shaft 50 by means of set screws 60, 62. As particularly illustrated in FIG. 2, the drive shaft 50 further carries drive gears 64, 66 which in turn engage idler gears 68, 70 respectively, providing power to a pair of driven gears 72, 74. Gears 64, 68 and 72, and gears 66, 70 and 74 are respectively carried in two upright casings 78, 80 which are preferably sealed and packed with grease or other suitable lubricant. As shown, the idler gears 68, 70 are respectively carried on shafts 82, 84, and the driven gears 72, 74 are respectively carried on shafts 86, 88.

Figure 6:
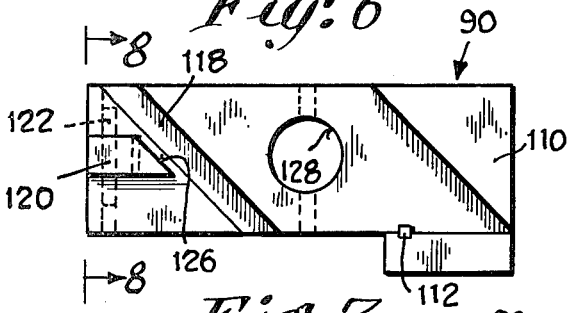
FIG. 6 is a side elevational view of one of the clamps employed in the resurfacing machine of FIG. 1, adapted to engage a mounting flange and the corresponding end flange of a turbine vane.
Figure 9:
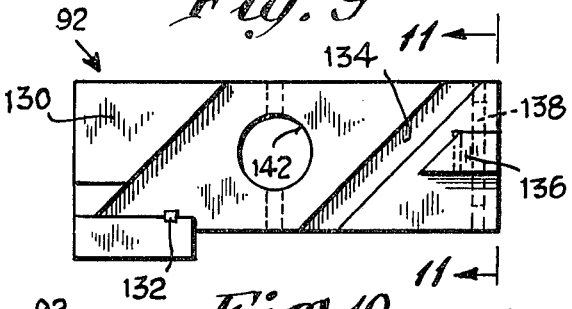
FIG. 9 is a side elevational view of the other of the clamps employed in the turbine vane resurfacing machine of FIG. 1, and adapted to engage another mounting flange and the corresponding end flange of the turbine vane.
Figure 7:
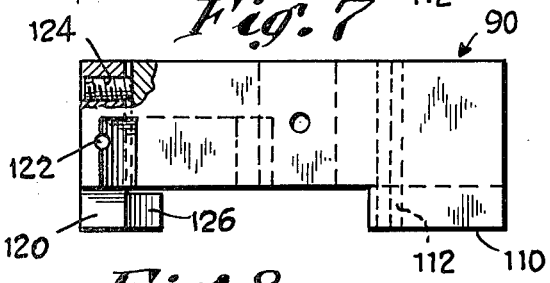
FIG. 7 is a top plan view of the clamp of FIG. 6.
Figure 10:
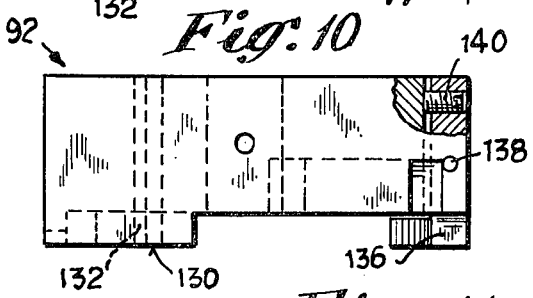
FIG. 10 is a top plan view of the clamp illustrated in FIG. 9.
Figure 8:
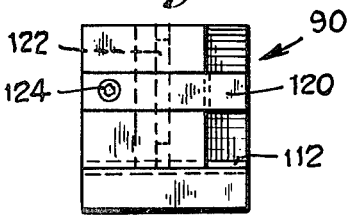
FIG. 8 is a view taken on line 8—8 of FIG. 6.
Figure 11:
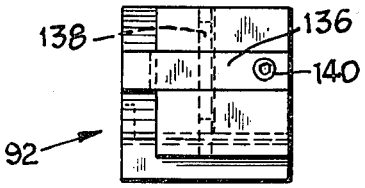
FIG. 11 is a view taken on line 11—11 of FIG. 9.
Figure 12:
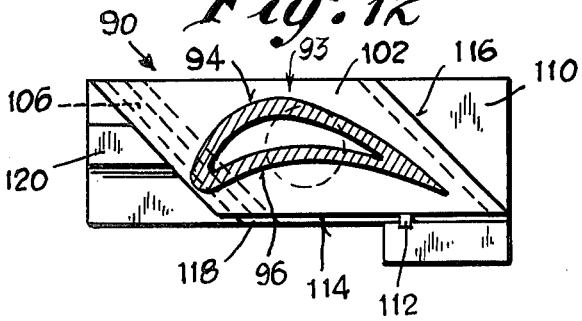
FIG. 12 is a view like FIG. 6, and particularly showing, partially in section, a typical turbine vane which has been secured in position on the clamp.
Figure 14:
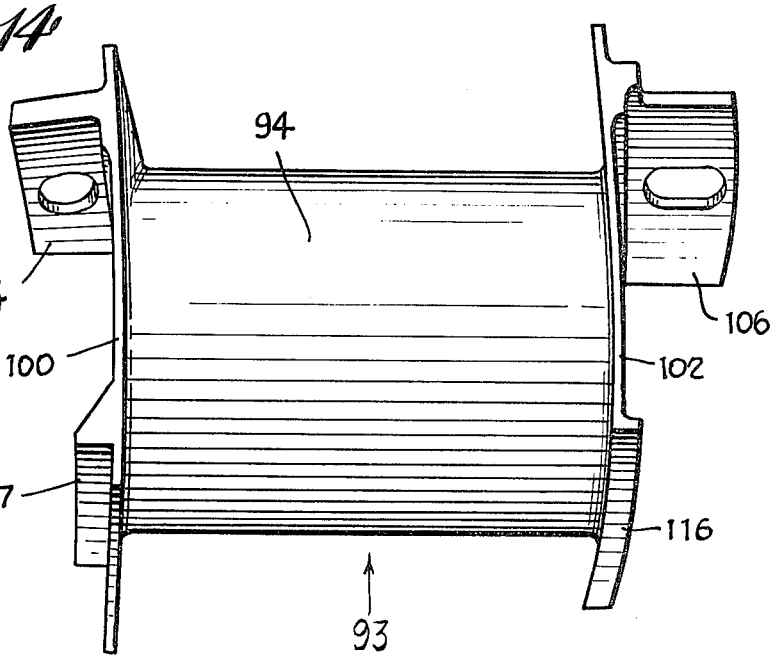
FIG. 14 is a top plan view of a typical turbine vane, particularly showing its upper convex surface, two end flanges, and two mounting flanges.
Figure 15:
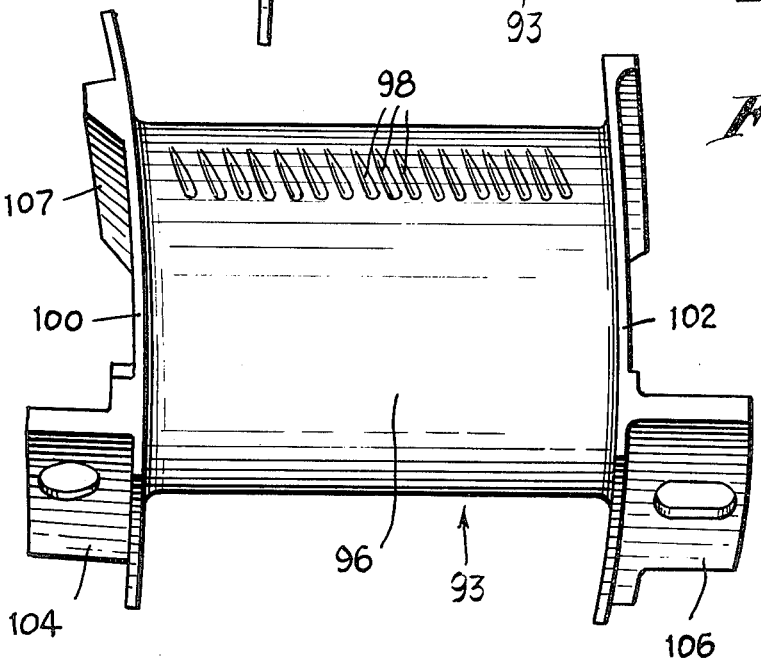
FIG. 15 is a bottom plan view of the turbine vane of FIG. 14, particularly showing the concave lower surface thereof and further illustrating a series of ventilating holes therein.

The shafts 86, 88 in turn carry a pair of clamps 90, 92 which are particularly illustrated in FIGS. 6-8 and FIGS. 9-11, respectively. In accordance with the present invention, the clamp 90 in FIGS. 6-8 is adapted to engage and retain one mounting flange and the corresponding end flange of a turbine vane 93 of the type illustrated in FIGS. 14 and 15. As shown, the vane 93 includes an upper convex surface 94 and a lower concave surface 96, the latter including a series of ventilating holes 98. The end flanges of the vane are designated by the numerals 100, 102, and the mounting flanges indicated by the numerals 104 and 106. The vane also has a positioning rib 107 disposed on the end flange 100. As shown in FIGS. 6-8, the clamp 90 includes a block having an abutment shoulder 110 and a hardened steel stop pin 112 which are adapted to engage adjacent edge portions 116, 114 respectively of the end flange 102 in the manner illustrated in FIG. 12. The mounting flange 106 is adapted to be received in a slot 118 (FIG. 6) in the block. A movable clamp jaw 120 is provided, which is pivotally mounted with respect to the block by means of a pivot pin 122. A set screw 124 is carried in the movable jaw, and effects pivotal movement of the jaw with respect to the block. By such an arrangement, backing off on the screw 124 will cause the leading edge 126 of the jaw to engage the edge portion of the end flange 102 which is opposite and parallel to the edge portion 116 illustrated in FIG. 12. This figure shows a typical turbine vane with the airfoil surface shown in section and the end flange 102 shown in elevation, as the vane would appear when clamped in position.

Referring now to FIGS. 9-11 and 13 and in accordance with the present invention there is provided a second clamp 92 somewhat similar to the first clamp 90. The clamp 92 is adapted to engage and securely hold the end flange 100 and mounting flange 104 of the turbine vane illustrated in FIGS. 14 and 15. The clamp 92 comprises a block including an abutment shoulder 130, and a hardened steel abutment pin 132. A slot 134 in the block is provided, to receive the mounting flange 104 of the turbine vane. An adjustable clamp jaw 136 is provided, pivotally carried on a pin 138, and including a set screw adjustment 140. Clamp 92 is thus adapted to engage and securely hold in place the end flange 100 and corresponding mounting flange 104 of the turbine vane of FIGS. 14 and 15. However, in this case the shoulder 130 butts against a positioning rib 107 on the end flange 100, and not against an edge portion of the flange, as was the case with the clamp 90.

Figure 13:
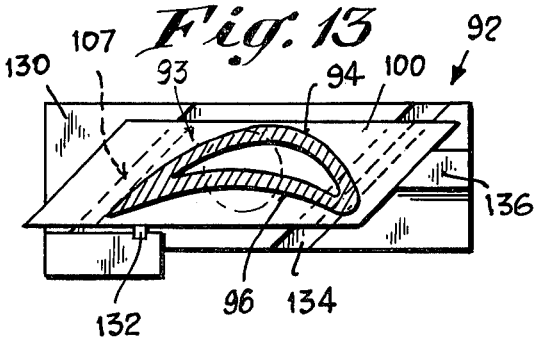
FIG. 13 is a view like FIG. 9, and particularly illustrating, partially in section, a turbine vane which has been secured in position on the other clamp.

A mounting hole 128 is provided in the clamp 90, as well as a similar mounting hole 142 in the clamp 92, to enable the clamps 90, 92 to be secured to the corresponding shafts 86, 88, respectively. Key holes are also provided, shown in dotted outline in FIGS. 6 and 9, for keying each shaft to its respective block by means of suitable pins 129 and 143 (FIG. 2). FIG. 13 shows the turbine vane of FIGS. 14 and 15 with the air-foil surface thereof in section and the end flange 100 in elevation, and illustrating the manner in which the turbine vane is held in position in the clamp.

Figure 5:
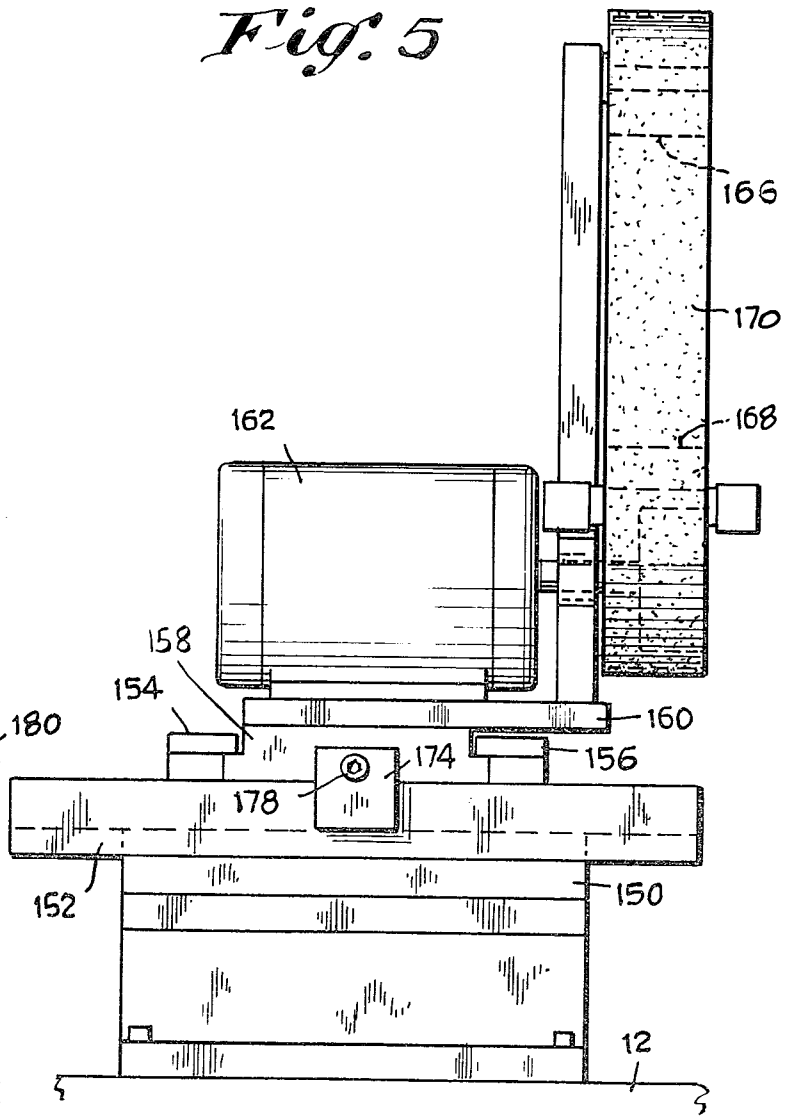
FIG. 5 is a view taken on line 5—5 of FIG. 4.
Figure 4:
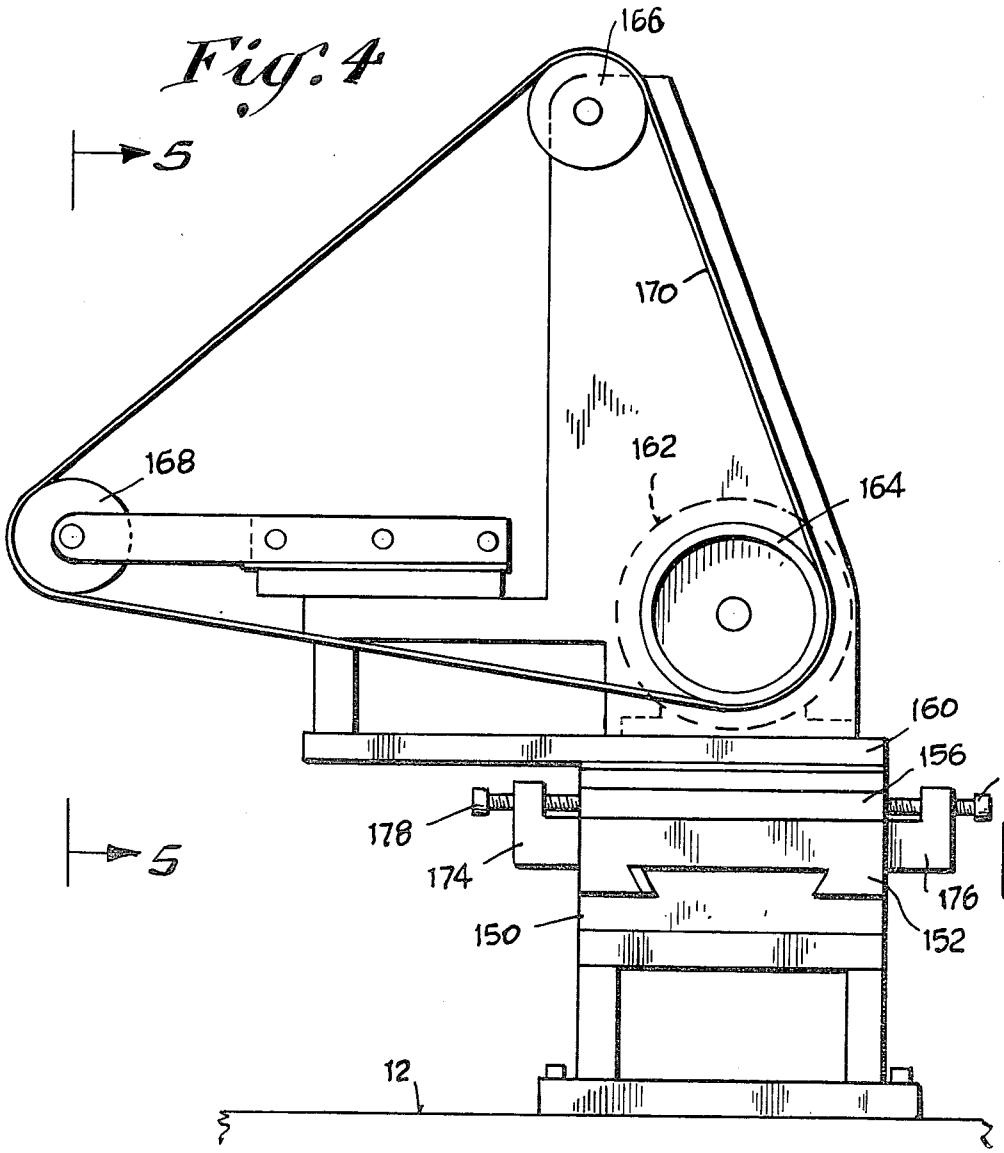
FIG. 4 is a fragmentary side elevational view of another portion of the resurfacing machine of FIG. 1, particularly illustrating an abrasive belt arrangement and adjustable means for positioning the belt with respect to the machine frame.

Referring now to FIGS. 1, 4 and 5, it can be seen that the frame 12 further includes an upstanding guide 150, which slidably carries a dove-tail slide 152. The latter in turn has a pair of up-standing blocks, 154, 156 which have undercut configurations and constitute a guide for a second movable slide 158. The latter in turn carries a frame 160 on which there is mounted an electric motor 162 having a drive pully 164 and two idler pulleys 166, 168 which carry an abrasive belt 170. In the appended claims, the term "work-performing station" is intended to refer to the area in the vicinity of the idler pulley 168, wherein the belt 170 engages the air-foil surface of the vane being resurfaced, as will be explained below. The dove-tail slide 152 includes extensions 174, 176 which respectively carry adjustment screws 178, 180 respectively for effecting positioning of the slide 158 with respect to the slide 152. By such an arrangement, it can be seen that the assemblage consisting of the frame 160, motor 162 and belt 170 can be adjusted in two perpendicular directions with respect to the frame 12.

Referring to FIGS. 1 and 3, it will now be seen that the carriage 32 can be advanced from left to right to impart a working stroke to the rotating vane 93, this being done by manual turning of the micrometer feed handle 22. The precise position of the carriage 32 is shown by a micrometer indicator device 181 illustrated in FIG. 3, comprising a dial indicator 183 carried by an adjustable angle bracket 185, said indicator having a feeler 187 engageable with an angle bracket 189 which is secured to the base plate 18. Thus, as seen in FIG. 3, a precise indication can be had of the amount of material to be removed from the vane 93 by the belt 170.

The indicator device 181 is utilized initially, in setting up the machine, by installing a master vane or pattern in the clamps 90, 92 and thereafter advancing the plate 18 by turning the feed handle 22. The position at which the master engages the abrasive belt 170 (or an equivalent dummy belt of equal thickness) is noted on the dial indicator 183. This is the target position to be attained during the actual refinishing of resurfaced vanes. The indicator device 181 is not shown in FIGS. 1 and 2 in the interest of clarity.

The operation of the improved turbine vane resurfacing machine of the present invention may now be readily understood by referring to FIGS. 1–3. FIG. 1 illustrates a turbine vane 93 of the type illustrated in FIGS. 14 and 15 secured in position on the clamps 90, 92. Under such circumstances, the cam 52 has roughly the position shown. In FIGS. 4 and 5, the position of the belt 170 can be adjusted as required, in order to align it with the center line of the air-foil surface of the turbine vane to be refinished. The crank handle 22 and lead screw 20 constitute means for positioning the plate 18 with respect to the frame 12. In use, the operator advances the screw 20 until the air-foil surface of the turbine vane is brought into engagement with the abrasive surface of the belt 170.

With the motor 162 providing drive power to the belt, and with the motor 42 also operating, providing drive power to the drive shaft 50, it will be seen that the cam 52 will rotate in synchronism with the shafts 86 and 88 which respectively carry the clamps 90, 92. This is due to the fact that the gears 64 and 72 and the gears 66 and 74 all have the same number of teeth. Accordingly, it will be seen that a single revolution of the shaft 50 will give rise to simultaneous single revolutions of the shafts 86 and 88, which in turn will effect a complete rotation of the turbine vane about an axis which is roughly perpendicular to the end flanges thereof, and which lies between and is parallel to the curved surfaces 94, 96 of the vane being resurfaced.

As the cam 52 is rotating, the spring 36 normally maintains the engagement thereof with the cam follower 54. By such an arrangement, the carriage 32 will undergo reciprocating movement with respect to the plate 18 according to the shape of the particular cam 52 employed. By precise dimensioning of the cam 52, the air-foil surface of the turbine vane will normally be maintained in continuous engagement with the abrasive surface of the belt 170, as the vane is rotated. We have found that such a structure provides highly satisfactory and repeatable performance as far as removing controlled quantities of the complete air-foil surfaces of the turbine vanes in a single operation. Typically the vane is left in the machine until a number of cycles of the cam 52 has been completed, to a point wherein no appreciable additional material is being removed from the vane air-foil surface by the belt 170. Following resurfacing of the airfoil surface in this manner the vane can be removed and any imperfections which remain on the end flanges or mounting flanges thereof can be refinished by hand, if desired.

As shown particularly in FIG. 1, there is provided an end stop 184 on the frame 12, including an adjustable screw 186 and a locking nut 188. Once a predetermined, fully-advanced position of the plate 18 with respect to the frame 12 has been reached, the set screw 186 can be advanced to bring the end thereof into engagement with the end surface of the plate 18, and the lock nut 188 tightened. Accordingly, following installation of a new vane in the clamps 90, 92, the operator can merely advance the lead screw 20 by increments, using the crank handle 22 until the movable carriage engages the end of the screw 186. This is particularly useful in resurfacing subsequent vane units of the same type, once a satisfactory setting for a first or master unit has been obtained.

The indicator device 181 will provide a visual check as to the precise, predetermined advanced position of the plate 18 and the carriage 32. Such an arrangement is useful in enabling the operator to determine the proper increments in rotating the crank handle 22, since the indicator device can show how much metal is being removed for each cut or rotation of the vane 93.

From the above it can be seen that I have provided a novel and improved turbine vane resurfacing machine which is both simple in construction and reliable in operation. I have found that the device provides highly satisfactory and uniform results in removing controlled quantities of the air-foil surface of a turbine vane, with a minimum of effort and a minimum of operator-related error introduced into the refinishing process. An important feature of the invention is the biasing of the carriage 32 as effected by the spring 36. During the initial cuts made on the vane 93, any excessively thick or high spots will not cause tearing of the belt 170 or excessive water. Instead, the carriage 32 can yield slightly under the excessive force applied to the vane 93 by the traveling belt 170, as by slight compression of the spring 36. Thereafter, the high spots will be smoothed out and the cam 52 will continuously remain in engagement with the follower 54 to effect the precise dimensional integrity desired in the refinished vane. The machine illustrated and described above has been found to provide more than adequate precision in order to effect resurfacing of the critical turbine vane part to the desired tolerances.

The device is thus seen to represent a distinct advance and improvement in the technology of turbine vane refurbishing machines.

Variations and modifications are possible without departing from the spirit of the invention.

I claim:

1. A machine for resurfacing in one operation both the convex and concave air-foil surfaces of turbine vanes and the like, comprising in combination:

a. a base part, b. a carriage part movable over the base part toward and away from a work-performing station thereon, c. an abrasive belt carried by the base part and a shaft and pully on said base part, around which the belt passes so as to present a convex cutting surface at said work-performing station, the radius of said pulley being less than the smallest radius of curvature of the concave air-foil surface of the vanes so as to admit the belt fully into the concave surface, d. powered means for driving the belt, e. means comprising a pair of axially aligned and axially spaced apart, independent shafts on the carriage part for rotatably mounting the opposite ends of the vane to be resurfaced and enabling the entire air-foil periphery thereof to be continuously presented for engagement with the cutting surface of the belt as the carriage part moves relative to the work-performing station, f. a cam carried by one of said parts and turnable about an axis thereon, said axis being parallel to and non-coaxial with said axially-aligned shafts and said cam being located opposite the space therebetween, g. a cam follower carried by the other of said parts and engaging said cam, said h. drive means connecting the cam and the vane mounting means to effect simultaneous synchronous rotation of the cam and the vane, whereby the resurfacing of the latter is governed by the particular contour of the cam, i. said drive means including means connected with the aligned shafts, for gearing the same together for simultaneous turning movement.

2. The invention as set forth in claim 1, wherein:

a. said drive means comprises a drive gear connected for simultaneous rotation with said cam, and a drive gear connected for simultaneous rotation with said vane mounting means.

3. The invention as set forth in claim 2, and further including:

a. an idler gear disposed between and engaging the drive gear and the driven gear, such that the latter two gears can undergo simultaneous rotation in the same direction.

4. The invention as set forth in claim 1, wherein:

a. said base part comprises a machine frame and a dove-tail slide carried thereby, and b. said carriage part being movable with respect to said dove-tail slide, c. manually operable means for adjustably positioning the dove-tail slide with respect to the machine frame.

5. The invention as set forth in claim 1, wherein:

a. said cam is rotatably carried by said carriage part, and said cam follower is rotatably carried by said base part.

6. The invention as set forth in claim 1, wherein:

a. said cam has a profile resembling the configuration of an airfoil surface.

7. The invention as set forth in claim 1, wherein:

a. said vane mounting means comprises a pair of clamps engageable respectively with the end flanges of the turbine vane being resurfaced.

8. The invention as set forth in claim 4, and further including:

a. micrometer indicator device carried by said base part and operatively connected with the machine frame and dove-tail slide, providing precise readings of the position of the slide whereby said readings constitute an indication of the refinished peripheral surface of the vane.

9. The invention as set forth in claim 8, wherein:

a. said indicator device comprises a dial indicator mounted on the machine frame, and an actuator arm carried by the dove-tail slide and cooperable with said dial indicator.

10. A machine for resurfacing the air-foil surfaces of turbine vanes and the like, comprising in combination:

a. a base part, b. a carriage part movable over the pase part toward and away from a work-performing station thereon, c. an abrasive belt carried by the base part and presenting a cutting surface at said work-performing station, d. powered means for driving the belt, e. means on the carriage part for rotatably mounting the vane to be resurfaced and enabling the entire air-foil periphery thereof to be continuously presented for engagement with the cutting surface of the belt as the carriage part moves relative to the work-performing station, f. a cam carried by one of said parts and turnable about an axis thereon, g. a cam follower carried by the other of said parts and engaging said cam, and h. drive means connecting the cam and the vane mounting means to effect simultaneous synchronous rotation of the cam and the vane, whereby the resurfacing of the latter is governed by the particular contour of the cam, i. said vane mounting means comprising a pair of clamps engageable respectively with the end flanges of the turbine vane being resurfaced, j. one of the said clamps comprising a block having an abutment shoulder for engagement with an edge of one end flange of the vane, and a clamp jaw pivotally carried on the block and engageable with another edge of the end flange.

11. The invention as set forth in claim 10, wherein:

a. said block further includes means defining a slot to receive the vane mounting flange which is adjacent said end flange.

12. The invention as set forth in claim 10, wherein:

a. said block further includes a stop pin engageable with a third edge of said one end flange of the vane, b. said stop pin being constituted of hardened steel.

13. The invention as set forth in claim 10, wherein:

a. said vane mounting means comprises a shaft turnably carried by said carriage part, b. said block having a mounting hole receiving said shaft, and c. means keying said block to said shaft to effect simultaneous turning movement thereof.

14. The invention as set forth in claim 10, wherein:

a. the other of said clamps comprises a block having an abutment shoulder for engagement with a positioning rib on the other end flange of the vane, and a clamp jaw pivotally carried on the block of said other clamp and being engageable with an edge of said other end flange.

15. The invention as set forth in claim 14, wherein:

a. the block of said other clamp includes means defining a slot to receive the vane mounting flange which is adjacent said other end flange of the vane.

16. The invention as set forth in claim 14, wherein:

a. the block of said other clamp further includes a stop pin engageable with one edge of said other end flange of the vane.

17. The invention as set forth in claim 14, wherein:

a. said vane mounting means comprises a shaft turnably carried by said carriage part, b. the block of said other clamp having a mounting hole for receiving said shaft, and c. means keying the immediately preceding block to said shaft to effect simultaneous turning movement thereof.

* * * * *